US011160703B2

(12) United States Patent
Shimizu et al.

(10) Patent No.: US 11,160,703 B2
(45) **Date of Patent: *Nov. 2, 2021**

(54) ASSISTANCE DEVICE

(71) Applicant: FUJI CORPORATION, Chiryu (JP)

(72) Inventors: Satoshi Shimizu, Chiryu (JP); Joji Isozumi, Cupertino, CA (US); Takehiro Noguchi, Ama (JP); Takehiro Hiraoka, Chiryu (JP)

(73) Assignee: FUJI CORPORATION, Chiryu (JP)

( * ) Notice: Subject to any disclaimer, the term of this patent is extended or adjusted under 35 U.S.C. 154(b) by 144 days.

This patent is subject to a terminal disclaimer.

(21) Appl. No.: 16/331,325

(22) PCT Filed: Sep. 13, 2016

(86) PCT No.: PCT/JP2016/076951
§ 371 (c)(1),
(2) Date: Mar. 7, 2019

(87) PCT Pub. No.: WO2018/051406
PCT Pub. Date: Mar. 22, 2018

(65) Prior Publication Data

US 2019/0350784 A1 Nov. 21, 2019

(51) Int. Cl.
*A61G 5/14* (2006.01)
*A61G 7/10* (2006.01)

(52) U.S. Cl.
CPC ..... *A61G 5/14* (2013.01); *A61G 7/1019* (2013.01); *A61G 7/1038* (2013.01);
(Continued)

(58) Field of Classification Search
CPC ..... A61G 5/14; A61G 7/1019; A61G 7/1038; A61G 7/1046; A61G 7/1086; A61G 2203/20; A61G 2203/44; A61G 7/053
(Continued)

(56) References Cited

U.S. PATENT DOCUMENTS 10,729,604 B2 * 8/2020 Tsusaka ..... A61G 5/14
10,912,692 B2 * 2/2021 Kim ..... A61G 5/14
(Continued)

FOREIGN PATENT DOCUMENTS

CN 205007170 U 2/2016
EP 3 050 549 A1 8/2016
(Continued)

OTHER PUBLICATIONS

Australian Office Action dated May 20, 2019 in Australian Patent Application No. 2016423311, 4 pages.
(Continued)

*Primary Examiner* — Myles A Throop
(74) *Attorney, Agent, or Firm* — Oblon, McClelland, Maier & Neustadt, L.L.P.

(57) ABSTRACT

An assistance device that enables a caregiver or care receiver to understand a degree to which a load is applied in the front-rear direction of a body supporting member. The assistance device includes: the body supporting member configured to support the upper body of the care receiver; a load detecting device provided on the body supporting member and configured to detect a load applied by the care receiver; and a display device configured to display an extent to which a load is applied to the body supporting member in a front-rear direction of the body supporting member based on the load detected by the load detecting device.

5 Claims, 5 Drawing Sheets

(52) U.S. Cl.
CPC ..... *A61G 7/1046* (2013.01); *A61G 7/1086* (2013.01); *A61G 2203/20* (2013.01); *A61G 2203/44* (2013.01)

(58) Field of Classification Search
USPC ..... 5/83.1
See application file for complete search history.

(56) References Cited

U.S. PATENT DOCUMENTS

| | | | | |
|---|---|---|---|---|
| 2014/0026322 | A1* | 1/2014 | Bell | A61G 7/002 5/600 |
| 2015/0005938 | A1* | 1/2015 | Suzuki | B25J 11/009 700/253 |
| 2015/0060162 | A1* | 3/2015 | Goffer | A61G 5/124 180/41 |
| 2015/0190293 | A1* | 7/2015 | Hacikadiroglu | A61G 7/1017 5/87.1 |
| 2017/0128292 | A1* | 5/2017 | Tsusaka | A61G 5/14 |
| 2019/0183706 | A1* | 6/2019 | Shimizu | A61G 7/015 |

FOREIGN PATENT DOCUMENTS

| | | | |
|---|---|---|---|
| JP | 9-257556 | A | 10/1997 |
| JP | 2007-195814 | A | 8/2007 |
| JP | 2008-86586 | A | 4/2008 |
| JP | 2011-110080 | A | 6/2011 |
| JP | 2012-90771 | A | 5/2012 |
| JP | 2012-192901 | A | 10/2012 |
| JP | 2012-200409 | A | 10/2012 |
| JP | 2016-64124 | A | 4/2016 |
| JP | 2016-73506 | A | 5/2016 |
| WO | WO 2013/028961 | A1 | 2/2013 |
| WO | WO 2016/103497 | A1 | 6/2016 |

OTHER PUBLICATIONS

Extended European Search Report dated Jul. 17, 2019 in European Patent Application No. 16916191.6, 7 pages.
International Search Report dated Nov. 1, 2016 in PCT/JP2016/076951 filed Sep. 13, 2016.

* cited by examiner

ASSISTANCE DEVICE

TECHNICAL FIELD

The present application relates to an assistance device.

BACKGROUND ART

It is hoped that an assistance device that performs standing assistance for a care receiver also improves the ability of the care receiver to stand up using their own leg power. Thus, for a device that performs standing assistance for a care receiver, patent literature 1 and 2 disclose identifying to what extent the care receiver is using their own leg power (to what extent the care receiver is relying on the device).

An assistance device disclosed in patent literature 1, when performing standing assistance in a state with a part of the body of the care receiver held by a support member capable of being raised and lowered, determines the level of reliance by the care receiver on the device (to what extent the care receiver is using their own leg power) based on a load of a motor required to raise the support member. Further, an assistance device disclosed in patent literature 1 reports information visually or aurally in accordance with the level of reliance. Also, the assistance device reports messages of encouragement by comparing the current level of reliance with historical data of past levels of reliance.

Disclosed in patent literature 2 is being able to check how much force is being applied to an arm mechanism of an assistance device by using a detection section to detect force applied by a care receiver to the arm mechanism and displaying a detected value on, for example, a monitor or the like provided on the arm mechanism. In this case, a larger force applied means that the care receiver is not using their lower body, thus, for example, it is possible for the care receiver to check their rehabilitation progress themselves. Further, by comparing with past force information that has been memorized, it is possible to check how much effect rehabilitation has had since previously.

CITATION LIST

Patent Literature

Patent literature 1: JP-A-2008-86586
Patent literature 2: JP-A-2016-64124

BRIEF SUMMARY

Technical Problem

However, a conventional assistance device simply detects a load applied to a supporting member, and it is not possible for a caregiver or care receiver to understand a degree to which a load is applied in the front-rear direction of the supporting member.

An object of the present disclosure is to provide an assistance device that enables a caregiver or care receiver to understand a degree to which a load is applied in the front-rear direction of the supporting member.

Solution to Problem

An assistance device of the present disclosure is for supporting an upper body of a care receiver and performing standing assistance for the care receiver, the assistance device including: a base; a body supporting member provided on the base in a manner capable of being raised and lowered, and configured to support the upper body of the care receiver; a load detecting device configured to detect a load applied on the body supporting member by the care receiver; and a display device configured to display an extent to which a load is applied to the body supporting member in a front-rear direction of the body supporting member based on the load detected by the load detecting device.

The display device displays the extent to which a load is applied to the body supporting member in the front-rear direction of the body supporting member based on the load detected by the load detecting device. Thus, a caregiver or the care receiver is easily able to understand to what extent a load is applied in the front-rear direction of the body supporting member. Also, a caregiver or the care receiver, by understanding to what extent a load is applied in the front-rear direction of the body supporting member, for example, is able to evaluate to what extent the care receiver is using their own leg power, or the posture of the care receiver on the assistance device.

DESCRIPTION OF EMBODIMENTS

1. Configuration of Assistance Device

Figure 1:
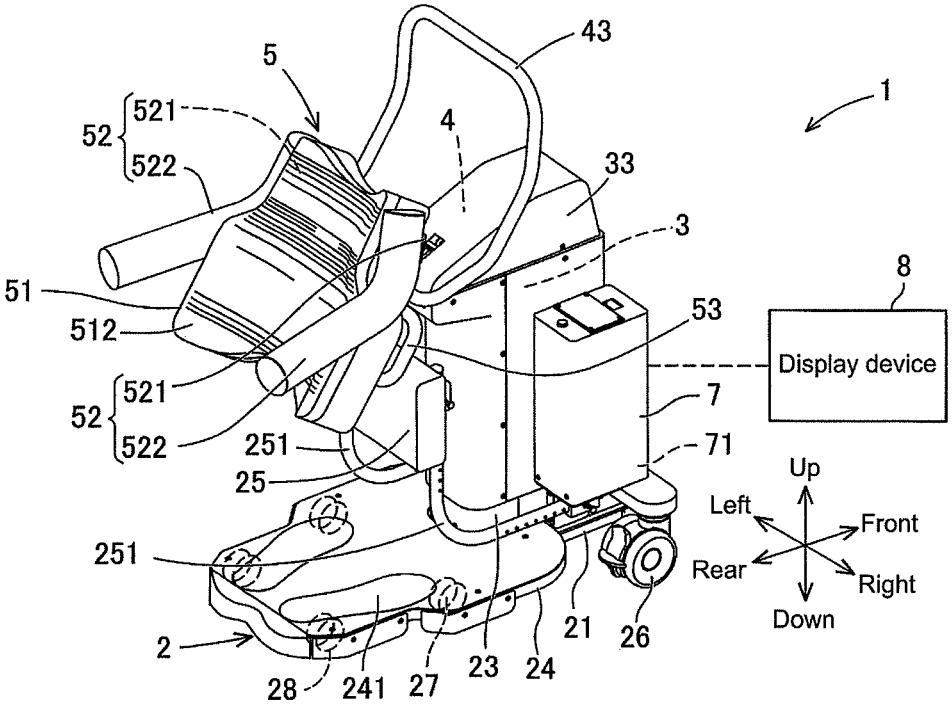
FIG. 1 is a perspective view of an assistance device seen diagonally from the rear in a state in which a care receiver is to get on in a sitting posture.

Assistance device 1 that assists a care receiver to move is described with reference to FIGS. 1 and 2. In the present disclosure, assistance device 1 is given as an example of a device that performs standing assistance and sitting assistance, but a device that performs other types of assistance may also be applied.

Assisting device 1 supports the upper body of care receiver M and assists care receiver M in standing up from a sitting posture to a standing posture. Further, assistance device 1 supports the upper body of care receiver M and assists care receiver M in sitting down from a standing posture to a sitting posture. Thus, assistance device 1 is capable of assisting care receiver to move and transfer somewhere.

A "standing posture" refers to a posture in which the lower body of care receiver M is upright, regardless of the posture of the upper body. That is, standing assistance is assistance for moving the position of the buttocks of care receiver M upwards. Further, sitting assistance is assistance for moving the position of the buttocks of care receiver M downwards.

Assistance device 1 is provided with base 2, raising and lowering section 3, oscillating section 4, body supporting member 5, load detection device 6, control unit 7, and display device 8. Base 2 includes frame 21, support column 22 (refer to FIG. 2), fixed cover 23, footrest 24, lower limb contacting section 25, and six wheels 26 to 28. Frame 21 is provided near floor surface F in a substantially horizontal manner. Support column 22 is provided upright on frame 21 towards the front and in the center in the left-right direction. Raising and lowering device section 32, described later, is provided inside support column 22 with a substantially rectangular cross section. Fixed cover 23 covers and protects support column 22 and around a lower section of raising and lowering member 31, which is described later.

Footrest 24 is fixed towards the rear of an upper surface of frame 21 in a substantially horizontal manner. Foot-shaped contact marks 241 indicating a position for the feet of care receiver M are provided on an upper surface of footrest 24. Lower limb contacting section 25 is arranged above and slightly to the front of contact marks 241 and is formed by a pair of L-shaped left and right support arms 251 and 251. Lower limb contacting section 25 is arranged straddling the upright portions of the left and right support arms 251 extending in the left-right direction. Lower limb contacting section 25 is a portion for the lower limbs of care receiver M to contact and is made of a cushion material. The arrangement height of lower limb contacting section 25 can be adjusted.

Three wheels, 26 to 28, are provided respectively on both the left and right sides on a lower side of frame 21. Each of the wheels 26 to 28 has a steering function for changing the movement direction and at least front wheels 26 have a locking function for restricting movement. Due to the steering function of the six wheels 26 to 28, assisting device 1 is not only capable of moving in a front-rear direction and changing directions, but is also capable of moving laterally (moving directly to the side) and spinning (rotating on the spot).

Raising and lowering section 3 is configured from items such as raising and lowering member 31, raising and lowering drive section 32, and raising and lowering cover 33. Raising and lowering member 31 is elongated in the up-down direction and supported on the rear surface of support column 22 to be movable up and down. In the present embodiment, raising and lowering member 31 moves up and down by vertically moving with respect to support column 22, but may also be made to move up and down by pivoting with respect to support column 22.

An upper section of raising and lowering member 31 protrudes to the rear and oscillating support section 34 is provided towards the end that protrudes to the rear. Oscillating drive section 42 is provided inside an upper portion of raising and lowering member 31. Raising and lowering drive section 32 arranged inside support column 22 drives the up-down movement of raising and lowering member 31. Raising and lowering cover 33 covers and protects raising and lowering member 31 and the upper part of support column 22. Raising and lowering cover 33 is attached to raising and lowering member 31 and moves up and down with raising and lowering member 31. A lower portion of raising and lowering cover 33 that moves up and down always overlaps an outside portion of fixed cover 23.

Oscillating section 4 includes oscillating member 41, oscillating drive section 42, and first handle 43. Oscillating member 41 is formed in an arm shape. Oscillating member 41 is provided to be capable of oscillating in a front-rear direction with respect to raising and lowering member 31. Specifically, an end of oscillating member 41 is supported by oscillating support section 34 of raising and lowering member 31 to be capable of oscillating. Oscillating drive section 42 provided inside an upper portion of raising and lowering member 31 oscillates an end of oscillating member 41 in the front-rear direction around the other end of oscillating member 41.

First handle 43 is provided integrally with the other end of oscillating member 41. First handle 43 is a roughly rectangular frame. First handle 43 extends in the front upper direction from the other end of oscillating member 41. The sides of first handle 43 are gripped by both hands of care receiver M. Further, the sides and front of first handle 43 are gripped by a caregiver to move assistance device 1.

Body supporting member 5 includes items such as torso support member 51, underarm support members 52 and 52, and second handle 53. Torso support member 51 includes support main body 511 and cushion 512. Support main body 511 is made of metal and is plate-shaped. The front underside of support main body 511 is supported by the other end of oscillating member 41. Accordingly, support main body 511 can be tilted in a front-rear direction with respect to raising and lowering member by oscillating drive section 42.

Further, support main body 511 is supported in a free-tilting manner in the front-rear direction with respect to oscillating member 41. Support main body 511 is capable of tilting within a predetermined angle range in the clockwise direction of FIG. 2 from the state shown in FIG. 2. It should be noted that free-tilting does not refer to tilting driven by an actuator or the like but tilting that is done manually.

Cushion 512 is fixed to the upper rear side of support main body 511. Cushion 512 is formed from a material that easily changes shape and has a surface that closely matches the shape of the torso of care receiver M. The support surface of cushion 512 makes contact with and supports the front surface of the torso of care receiver M. In particular, cushion 512 supports a portion ranging from the chest to the abdomen of care receiver M from below.

Underarm support members 52 and 52 are provided on the left and right sides of torso support member 51. Underarm support member 52 includes a support main body 521 and an underarm arm 522. Support main body 521 of underarm support member 52 is made of metal and is supported by support main body 511 of torso support member 51 to be capable of oscillating. Underarm arm 522 supports an underarm of care receiver M. Underarm arm 522 is a rod-shaped member formed into an L-shape. The surface of underarm arm 522 is covered with a material that can flexibly deform.

Second handle 53 is integrally provided on the front surface of support main body 511 of torso support member 51. Second handle 53 is U-shaped elongated in the horizontal direction. Second handle 53 includes a base shaft fixed to the lower end of support main body 511 and extending in a left-right direction, and a gripping portion extending from both ends of the base shaft toward first handle 43.

Figure 2:
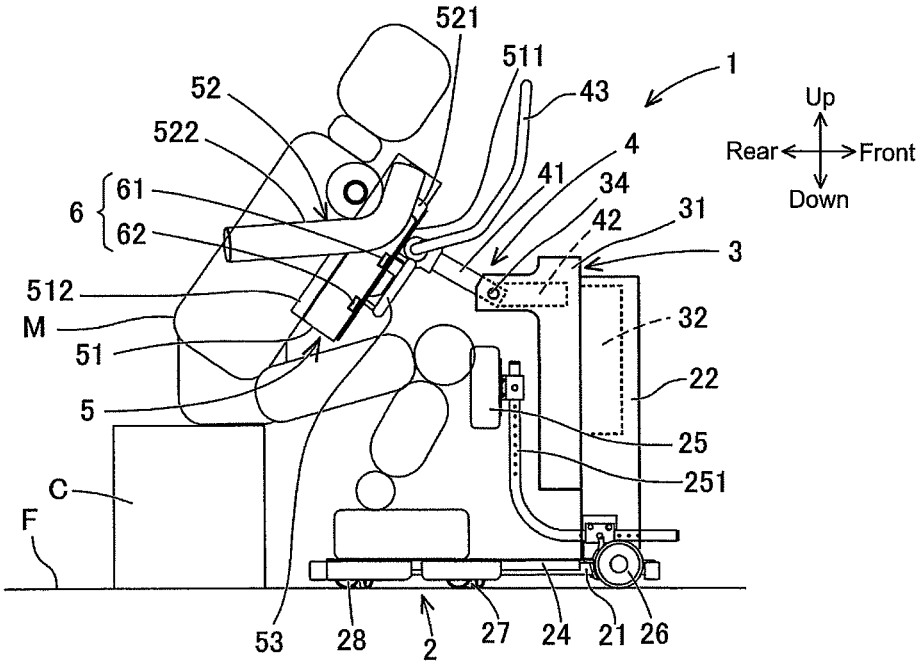
FIG. 2 is a side view of the assistance device of FIG. 1 also showing a care receiver in a sitting posture when standing assistance is to start.

As shown in FIG. 2, loading detecting device 6 is attached to torso support member 51 and is for detecting a load applied by the upper body of care receiver M. Load detecting device 6 is attached to an upper surface of support main body 511 and is sandwiched between support main body 511 and cushion 512. Load detecting device 6 includes first load detecting apparatus 61 and second load detecting apparatus 62.

First loading detecting apparatus 61 is provided near a central position in the up-down direction (front-rear direction) of support main body 511. First load detecting apparatus 61 corresponds to a first portion (for example, near the chest) of the upper body of care receiver M. First loading detecting apparatus 61 detects first load a applied by care receiver M. First load detecting apparatus 61 continuously acquires first load a during a specified sampling time while the power to assistance device 1 is turned on. There are two first load detecting apparatuses 61 arranged separated on the left and right.

Second load detecting apparatus 62 is provided below and to the rear of first load detecting apparatus 61. Second load detecting apparatus 62 corresponds to a second portion (for example, near the abdomen) of the upper body of care receiver M that is below and to the rear of the first portion of the upper body of care receiver M. Second load detecting apparatus 62 detects second load b applied by care receiver M. Second load detecting apparatus 62 continuously acquires second load b during a specified sampling time while the power to assistance device 1 is turned on. There are two second load detecting apparatuses 62 arranged separated on the left and right.

Control unit 7 is provided on an upper right side of frame 21. Control unit 7 includes control device 71 that controls raising and lowering drive section 32 and oscillating drive section 42. Control device 7 controls raising and lowering drive section 32 and oscillating drive section 42 based on instructions from care receiver M or a caregiver. A computer running software may be used as control device 7. The computer may be provided with a remote control, not shown, for receiving instructions from care receiver M or the caregiver. A standing-assistance program for assisting in standing and a sitting-assistance program for assisting in sitting may be stored as executable software. A rechargeable battery pack, reference numeral omitted, is attached to the lower side of control device 71. The battery pack is also attached to the top left side of frame 21. The battery pack is also shared with raising and lowering drive section 32 and oscillating drive section 42.

Display device 8 includes a display screen that displays various items of information to a caregiver or care receiver M. In the present embodiment, display device 8 displays the extent to which a load is applied to body supporting member 5 in the front-rear direction of body supporting member 5 based on the load detected by load detecting device 6. In particular, display device 8 displays to what extent a load is applied in the front-rear direction of body supporting member 5 based on first load a and second load b.

Here, display device 8 may be provided integrally with a main body item of the assistance device (2, 3, 4, 5, 6, 71). In this case, display device 8 may be attached to oscillating section 4 or body supporting member 5, or may be attached to control unit 7. Note that, main body items of the assistance device include base 2, raising and lowering section 3, oscillating section 4, body supporting member 5, load detecting device 6, and control device 71.

Also, display device 8 may be provided separately to main body items of the assistance device (2, 3, 4, 5, 6, 71). In this case, display device 8 may acquire data via wireless communication with control unit 7 to display the various information. Display device 8 may be a computer or mobile terminal such as a tablet or smartphone. Display device 8, even when not near a main body item of the assistance device (2, 3, 4, 5, 6, 71), may acquire various information from control unit 7 and display the acquired information.

2. Assistance Operation of Assistance Device 1

Figure 3:
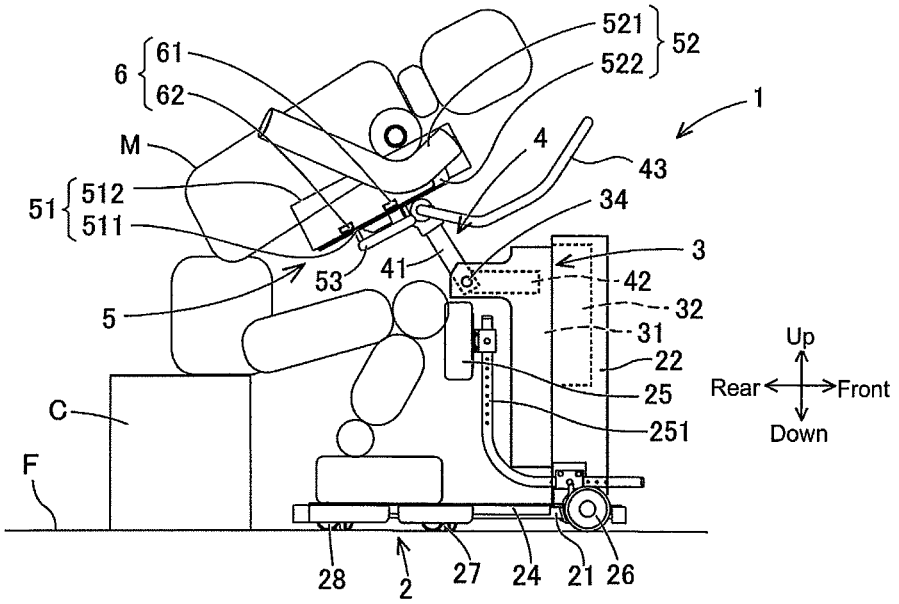
FIG. 3 is a side view of the assistance device in a state moved to a standing preparation posture with the care receiver also shown in a standing preparation posture.
Figure 4:
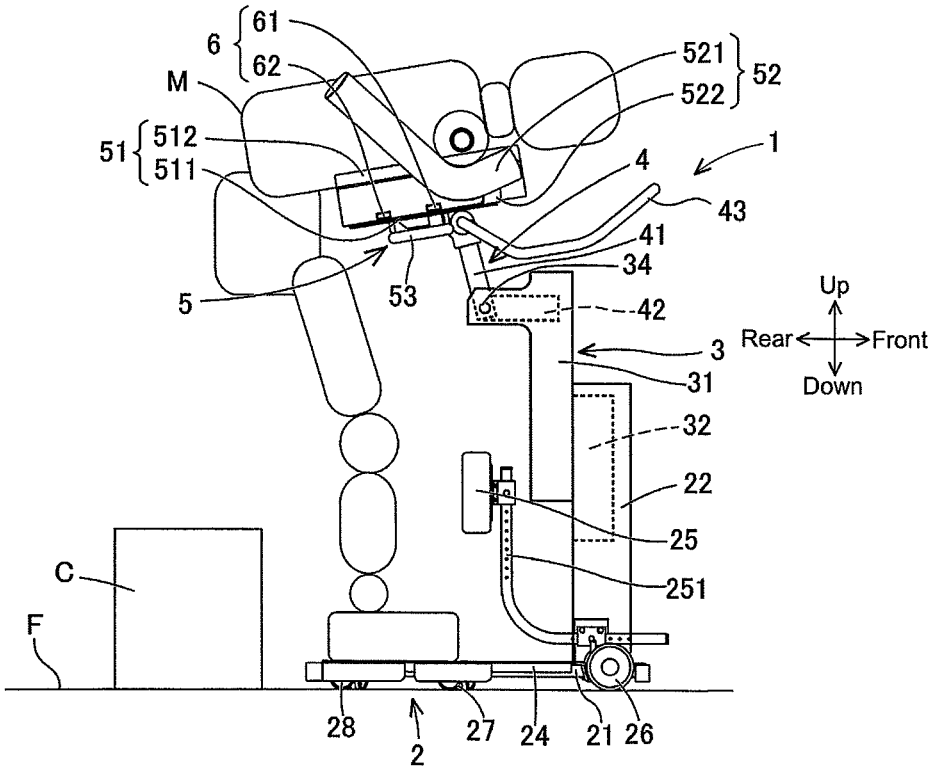
FIG. 4 is a side view of the assistance device in a state moved to a standing posture with the care receiver also shown in a standing posture.

Standing assistance of assistance device 1 is described next with reference to FIGS. 2 to 4. With standing assistance, assistance device 1 has a starting state as shown in FIG. 2, then assumes a standing preparation state as shown in FIG. 3, then a standing complete state as shown in FIG. 4.

First, a caregiver moves assistance device 1 close to care receiver M in a sitting posture. Here, as shown in FIG. 2, a caregiver moves assistance device 1 such that a care receiver M in a sitting posture can get on assistance device 1. Also, the caregiver adjusts the height of raising and lowering member 31 in accordance with the height of care receiver M. Continuing, care receiver M puts both legs under body supporting member 5. If body supporting member 5 is in the way, care receiver M or the caregiver can raise the lower end of body supporting member 5 manually to allow care receiver M to easily insert their legs under body supporting member 5.

Next, care receiver M places both feet on contact marks 241 and brings their lower legs in contact with lower limb contacting section 25. Further, care receiver M places their torso on the support surface of cushion 512 of torso support member 51. That is, the upper body of care receiver M is in a posture tilted slightly forward and supported by body supporting member 5. At the same time, care receiver M inserts underarm arms 522 under their arms. In this manner, assistance device 1 is set to the starting state of standing assistance. Then, the caregiver allows care receiver M to grip first handle 43. The posture of care receiver M at this time is the starting posture of standing assistance.

Continuing, the caregiver starts driving of assistance device 1 based on the standing assistance program of assistance device 1. By this, raising and lowering of raising and lowering member 31 is performed in conjunction with tilting forwards of oscillating member 41.

When the standing assistance program is performed, assistance device 1 enters the standing preparation state shown in FIG. 3. The standing preparation state of assistance device 1 is the state directly before care receiver M in the sitting posture is lifted from seat C. In other words, assistance device 1, from the starting state shown in FIG. 2, lowers raising and lowering member 31 and tilts oscillating member 41 forward to enter the standing preparation state shown in FIG. 3. Here, when assistance device 1 is in the standing preparation state, the buttocks of care receiver M are in contact with the seat surface of seat C and their torso is tilted forward and extended. The posture of care receiver M at this point is referred to as the standing preparation posture.

When the standing assistance program is continued, as shown in FIG. 4, raising and lowering member 31 is raised and oscillating member 41 is tilted forward further and then the standing assistance program ends. Upon this, care receiver M has changed from the standing preparation posture to a standing posture. In other words, the upper body of care receiver M in the standing posture tilts forwards a large amount and the position of the buttocks of care receiver M is higher than the seat surface of seat C. The legs of care receiver M are almost fully extended.

In this manner, after care receiver M has got onto assistance device 1 and torso support member 51 has been tilted forwards, care receiver M transfers from the starting posture of a sitting posture to a standing posture via the standing preparation posture.

Sitting assistance of assistance device 1 is performed by essentially performing a reverse operation of standing assistance. That is, by tilting torso support member 51 backwards while lowering raising and lowering member 31, care receiver M can move from a standing posture to a sitting posture. And, care receiver M in the sitting posture can easily remove their arms from underarm arms 522.

3. Detailed Configuration of Control Unit 7

Figure 5:
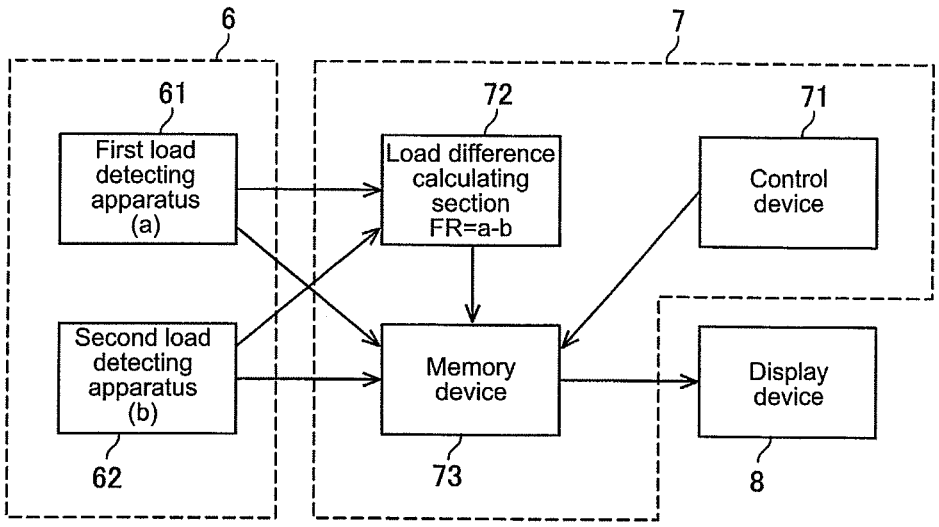
FIG. 5 shows the configuration of control unit 7.

The detailed configuration of control unit 7 will be described next with reference to FIG. 5. As shown in FIG. 5, control unit 7 is provided with control device 71, load difference calculating section 72, and memory device 73. Descriptions of contents of the above control device 71 are omitted here.

Load difference calculating section 72 acquires first load a and second load b. Here, as described above, first load a and second load b are acquired at a specified sampling time after the power of assistance device 1 is turned on. That is, first load a and second load b are acquired not only at the starting state and the end state of standing operation, but are also acquired before entering the starting state of standing assistance and after the completion of standing.

Also, load difference calculating section 72, based on first load a and second load b, calculates difference FR (also referred to as the load difference) between first load a and second load b as a value representing the extent to which a load is applied on body supporting member 5 in the front-rear direction of body supporting member 5. Here, load difference FR is second load b subtracted from first load a (a-b). In other words, in a case in which the load of the upper part (chest part) of care receiver M is larger than the load of the lower part (near the abdomen), load difference FR is positive. On the other hand, in a case in which the load of the upper part (chest part) of care receiver M is smaller than the load of the lower part (near the abdomen), load difference FR is negative.

In a case in which, during standing operation, the posture of care receiver M on the assistance device is good and care receiver M is using their own leg power, first load a is larger than second load b, or, even if second load b is larger than first load a, the difference between the two is not large. On the other hand, in a case in which care receiver M is hardly using their own leg power at all, or if their posture is not good, second load b will be much larger than first load a. The size relationship between first load a and second load b can be known from load difference FR.

Memory device 73 memorizes first load a, second load b, and load difference FR. Further, memory device 73 memorizes information used by control device 71 for controlling raising and lowering drive section 32 and oscillating drive section 42 (operation trajectory information) linked to information a, b, and FR. Information memorized on memory device 73 is output to display device 8 and used for creating a display on a display screen of display device 8.

4. Display Screen of Display Device

The display screen of display device 8 is described next with reference to FIGS. 6 to 10. Display device 8 displays information memorized on memory device 73 of control unit 7 on a display screen. Described below are display screens in a case in which the posture of care receiver M on the assistance device is good and they are using their own leg power to a reasonable extent (referred to below as a correct situation) (see FIGS. 6 to 8), and in a case in which the posture of care receiver M on the assistance device is not good and they are not using their own leg power to a reasonable extent (referred to below as an incorrect situation) (see FIGS. 9 and 10).

Figure 6:
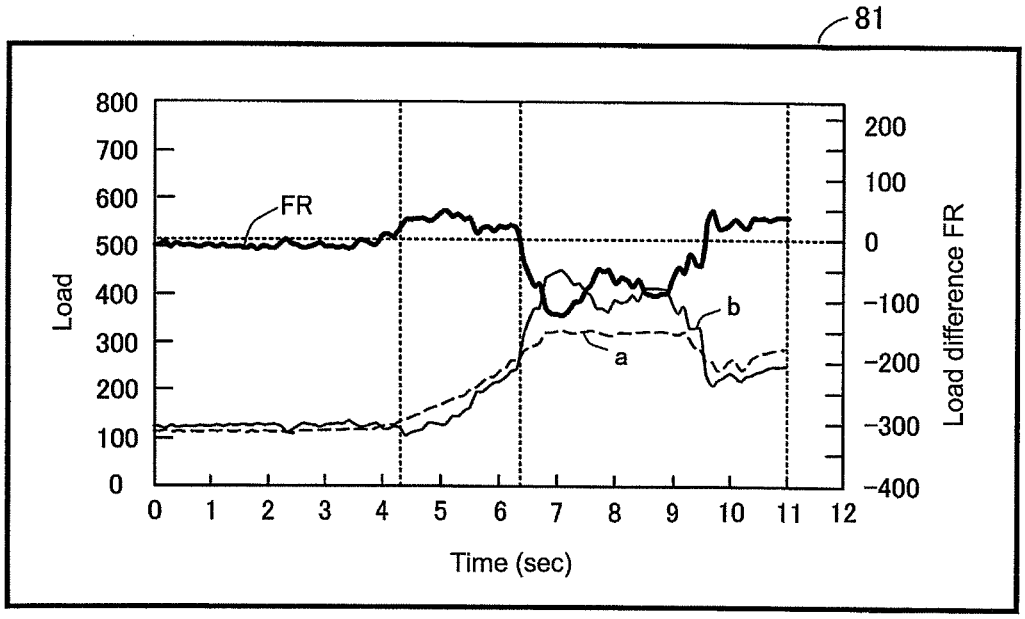
FIG. 6 shows display screen 81 of display device 8, which displays various pieces of information, in a case in which the posture of care receiver M on the assistance device is good and they are using their own leg power.

As shown in FIG. 6, first display screen 81 displays trends in information a, b, and FR during a single instance of standing assistance. Here, as shown in FIG. 6, in a correct situation, first display screen 81 displays a graph for a state in which standing assistance starts at around 4.3 seconds, entering the standing preparation state at which the buttocks of the care receiver separate from the seat surface of seat C at around 5.4 seconds, and finishing at 11 seconds.

As shown in FIG. 6, first load a and second load b are around 100 until close to 4.3 seconds, then increase after 4.3 seconds when standing assistance starts. While they are both increasing, first load a is slightly larger than second load b. After that, first load a and second load b both fluctuate. During this time, first load a becomes smaller than second load b. Due to the trends of first load a and second load b as shown, load difference FR is close to zero until 4.3 seconds, then becomes slightly positive before changing to a negative value. The minimum value of load difference FR is around −100.

Figure 7:
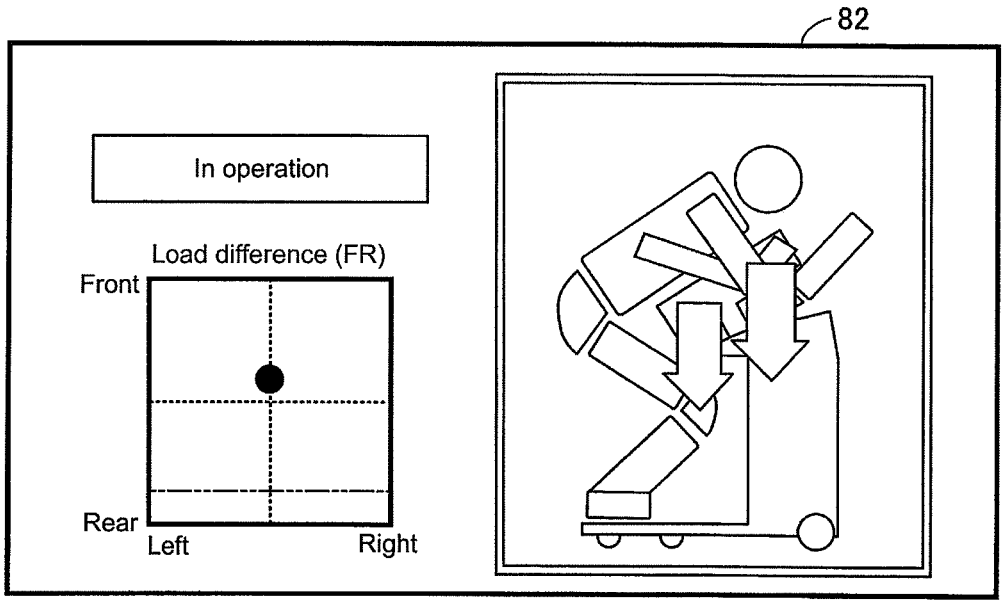
FIG. 7 shows display screen 82 of display device 8 in a case in which the posture of care receiver M on the assistance device is good and they are using their own leg power.
Figure 8:
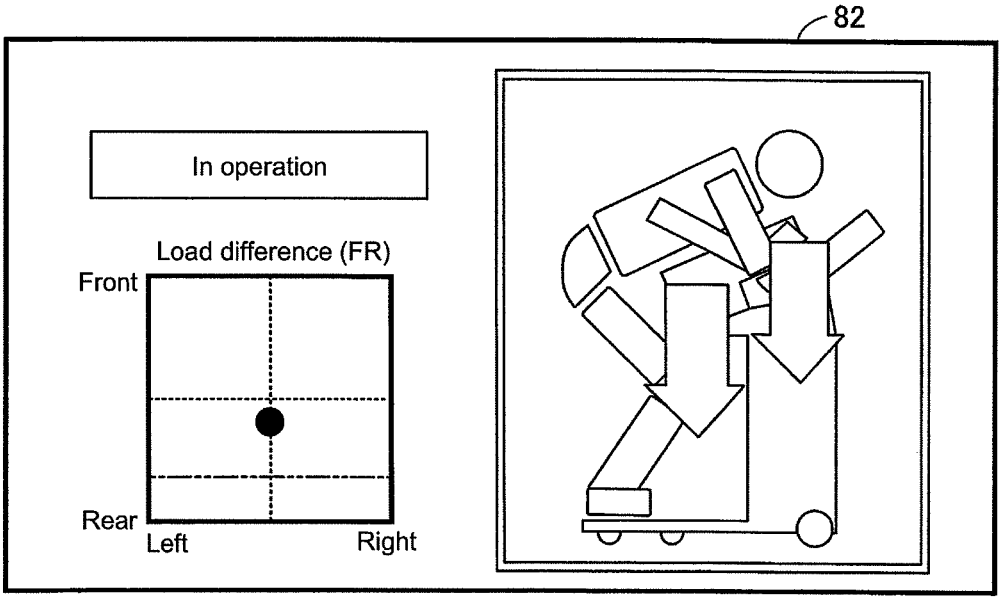
FIG. 8 shows display screen 82 of display device 8 in a case in which the posture of care receiver M on the assistance device is good and they are using their own leg power.

Second display screen 82 in a correct situation is shown in FIGS. 7 and 8. Second display screen 82 shown in FIG. 7 corresponds to around the time of 6 seconds on first display screen 81 shown in FIG. 6. Second display screen 82 shown in FIG. 8 corresponds to around the time of around 8 seconds on first display screen 81 shown in FIG. 6. Second display screen 82 is a moving display.

On the right side of second display screen 82, a side view of assistance device 1 and care receiver M is displayed as an animated image (moving image). The animation displays based on the operation trajectory information obtained from control device 71. Here, the animation may show only assistance device 1, or only body supporting member 5, so long as at least body supporting member 5 is shown.

Further, on the right side of second display screen 82, first load a and second load b are shown together in the animation at a position corresponding to body supporting member 5. First load a and second load b are displayed as arrows, and the length of the arrows corresponds to the size of first load a and the size of second load b.

FIG. 7 shows a point a little after the time at which the buttocks of care receiver M have separated from the seat surface of seat C. At this point, the arrow corresponding to first load a is longer than the arrow corresponding to second load b. In other words, first load a is larger than second load b. FIG. 8 shows a point at which the buttocks of care receiver M have separated a long way from the seat surface of seat C. At this point, the arrow corresponding to first load a is shorter than the arrow corresponding to second load b. In other words, first load a is smaller than second load b. The first load a and the second load b displayed in FIG. 8 are both larger compared to FIG. 7.

On the left side of second display screen 82, the current load difference FR is displayed in a frame as a dot. The position of the dot represents load difference FR changes based on the animation on the right side of second display screen 82 and the changes in first load a and second load b.

Here, a central point in the frame (intersection of dotted lines) is where load difference FR is zero. For the upper part of the frame, first load a is larger than second load b, that is, the load is towards the front side. In FIG. 7, the current load difference FR shows a load towards the front. On the other hand, for the lower part of the frame, second load b is larger than first load a, that is, the load is towards the rear side. In FIG. 8, the current load difference FR shows a load towards the rear.

The two-dashed broken line in the frame is the lower limit threshold value, and a load difference FR below this lower limit threshold value indicates an incorrect situation. Also, the box in the left right of second display screen 82 displays in operation or stopped to show the current operational state of assistance device 1. In FIGS. 7 and 8, because load difference FR is equal to or greater than load difference FR, it can be understood that both are correct situations. A caregiver or care receiver M is able to grasp to what extent care receiver M is using their legs and that care receiver M is on assistance device in a correct manner.

Figure 9:
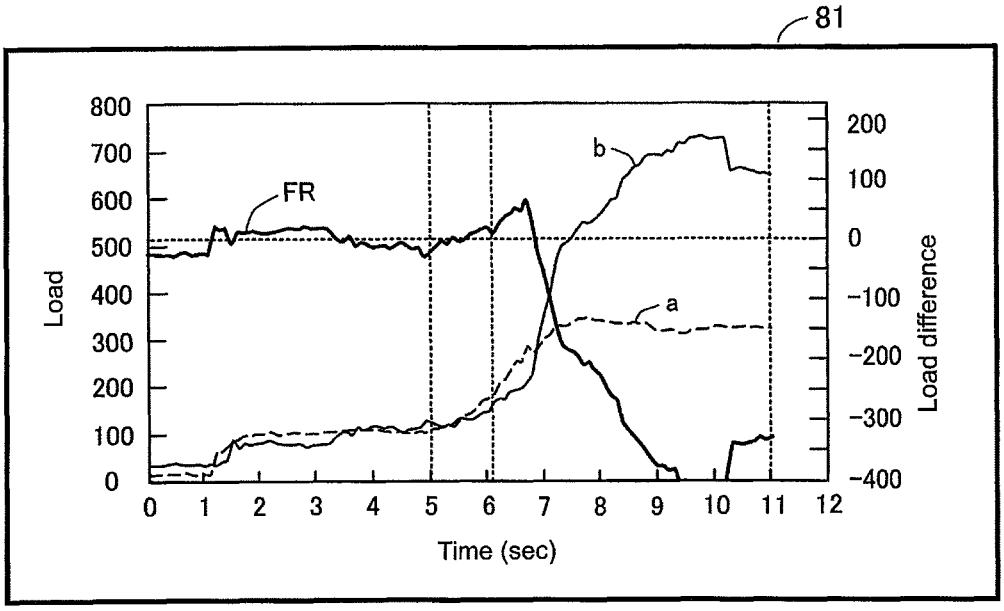
FIG. 9 shows display screen 81 of display device 8, which displays various pieces of information, in a case in which the posture of care receiver M on the assistance device is not good and they are not using their own leg power.

Next, as shown in FIG. 9, in an incorrect situation, first display screen 81 displays a graph for a state in which standing assistance starts at around 5 seconds, entering the standing preparation state at which the buttocks of the care receiver separate from the seat surface of seat C at around 6.1 seconds, and finishing at 11 seconds.

As shown in FIG. 9, first load a and second load b are around 100 until close to 5 seconds, then increase after 5 seconds when standing assistance starts. While they are both increasing, first load a is slightly larger than second load b. After that, first load a decreases rapidly and second load b continues to increase. During this time, first load a becomes much smaller than second load b. Due to the trends of first load a and second load b as shown, load difference FR is close to zero until 5 seconds, then becomes slightly positive before rapidly changing to a negative value. The minimum value of load difference FR is lower than −400.

Figure 10:
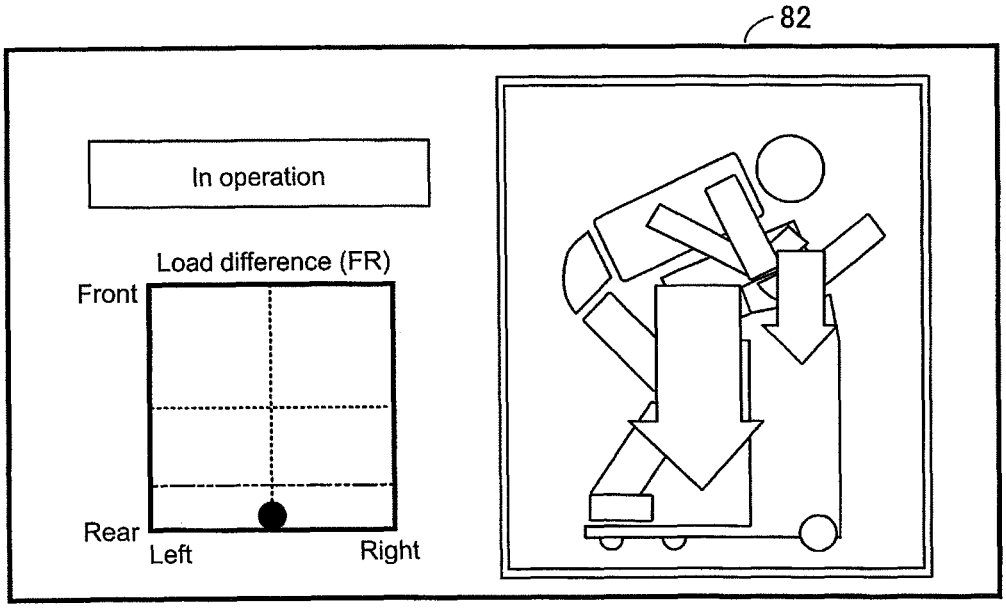
FIG. 10 shows display screen 82 of display device 8 in a case in which the posture of care receiver M on the assistance device is not good and they are not using their own leg power.

Second display screen 82 in an incorrect situation is shown in FIG. 10. Second display screen 82 shown in FIG. 10 corresponds to around the time of around 9 seconds on first display screen 81 shown in FIG. 9. As shown on the right side of FIG. 10, the arrow corresponding to second load b is very long, but the arrow corresponding to first load a is very short. Also, in the frame on the left side of FIG. 10, the dot is positioned below the lower limit threshold value, indicating an incorrect situation. A caregiver or care receiver M is able to grasp to what extent care receiver M is using their legs and that care receiver M is on assistance device in an incorrect manner.

5. Effects of Embodiments

Assistance device of the present embodiment supports the upper body of care receiver M and assists care receiver M to stand up. Assistance device 1 includes: base 2; body supporting member 5 provided on base 2 in a manner capable of being raised and lowered, and configured to support the upper body of care receiver M; load detecting device 6 provided on body supporting member 5 and configured to detect a load applied by care receiver M; and display device 8 configured to display an extent to which a load is applied to body supporting member 5 in a front-rear direction of body supporting member 5 based on the load detected by load detecting device 6.

Display device 8 displays the extent to which a load is applied to body supporting member 5 in the front-rear direction of body supporting member 5 based on the load detected by load detecting device 6. Thus, a caregiver or care receiver M is easily able to understand to what extent a load is applied in the front-rear direction of body supporting member 5. Also, a caregiver or care receiver M, by understanding to what extent a load is applied in the front-rear direction of body supporting member 5, for example, is able to evaluate to what extent care receiver M is using their own leg power, or the posture of care receiver M on the assistance device.

Load detecting device 6 includes first loading detecting apparatus 61 configured to detect a first load applied by care receiver M, and second load detecting apparatus 62 provided on body supporting member 5 at a position rearwards of first load detecting apparatus 61, and configured to detect a second load applied by care receiver M, and display device 8 is configured to show the extent to which the load is applied based on first load a and second load b. Thus, a caregiver or care receiver M can reliably understand to what extent a load is applied in the front-rear direction of body supporting member 5.

Assistance device 1 is also provided with raising and lowering member 31 provided on base 2 capable of being raised and lowered. Body supporting member 5 is provided on raising and lowering member 31 to be tiltable in a front-rear direction and supports the upper body of care receiver M. In this manner, because body supporting member 5 is configured to be tiltable in a front-rear direction on raising and lowering member 31, a caregiver or care receiver M, by understanding to what extent a load is applied in the front-rear direction of body supporting member 5, for example, is able to reliably evaluate to what extent care receiver M is using their own leg power, or the posture of care receiver M on the assistance device.

Also, second display screen 82 of display device 8 displays the difference between first load a and second load b (load difference FR) as the extent to which a load is applied in the front-rear direction on body supporting member 5. In a case in which, during standing operation, the posture of care receiver M on the assistance device is good and care receiver M is using their own leg power, first load a is larger than second load b, or, even if second load b is larger than first load a, the difference between the two is not large. On the other hand, in a case in which care receiver M is hardly using their own leg power at all, or if their posture is not good, second load b will be much larger than first load a. The size relationship between first load a and second load b can be known from load difference FR. Here, by display device 8 displaying load difference FR, a caregiver or care receiver M is able to suitably understand to what extent care receiver M is using their own leg power and the posture of care receiver M on the assistance device.

Further, second display screen 82 of display device 8 displays the size of each of first load a and second load b along with load difference FR as the extent to which a load is applied in the front-rear direction on body supporting member 5. Thus, a caregiver or care receiver M can understand in more detail to what extent a load is applied in the front-rear direction of body supporting member 5.

Also, second display screen 82 of display device 8 displays load difference FR, the sizes of first load a and second load b, and an animated image of body supporting member 5 all together. Thus, a caregiver or care receiver M is able to understand at what timing the load applied to body supporting member 5 changes. In particular, second display screen 82 displays load difference FR, the sizes of first load a and second load b, and an animated image of assistance device 1 overall and care receiver M all together. Thus, a caregiver or care receiver M can more easily understand operation of assistance device 1 and can easily the timing of changes in the load.

REFERENCE SIGNS LIST

1: assistance device;
2: base;
3: raising and lowering section;
4: oscillating section;
5: body supporting member;
6: load detecting device;
8: display device;
31: raising and lowering member;
32: raising and lowering drive section;
41: oscillating member;
42: oscillating drive section;
51: torso support member;
52: underarm support member;
61: first load detecting apparatus;
62: second load detecting apparatus;
71: control device;
72: load difference calculating section;
73: memory device;
a: first load;
b: second load;
FR: load difference;
M: care receiver

The invention claimed is:

1. An assistance device for supporting an upper body of a care receiver and performing standing assistance for the care receiver, the assistance device comprising:

a base;

a body supporting member provided on the base in a manner capable of being raised and lowered, and configured to support the upper body of the care receiver;

a load detecting device configured to detect a load applied on the body supporting member by the care receiver;

a control unit configured to control movement of the body supporting member; and a display device configured to display an extent to which a load is applied to the body supporting member in a front-rear direction of the body supporting member based on the load detected by the load detecting device, wherein the load detecting device includes a first loading detecting apparatus disposed on the body supporting member and configured to detect a first load applied by the care receiver, and a second load detecting apparatus disposed on the body supporting member at a position rearwards of the first load detecting apparatus, and configured to detect a second load applied by the care receiver, wherein the control unit includes a load difference calculating section configured to calculate a difference between the first load and the second load, and wherein the display device is configured to display the extent based on the difference.

2. The assistance device according to claim 1, wherein the display device is configured to display the difference between the first load and the second load and a size of each of the first load and the second load as the extent to which the load is applied.

3. The assistance device according to claim 2, wherein the display device is configured to display the difference between the first load and the second load and the size of each of the first load and the second load together with an animated image of the body supporting member.

4. The assistance device according to claim 1, further comprising a raising and lowering member provided on the base in a manner capable of being raised and lowered, wherein the body supporting member is provided on the raising and lowering member in a manner capable of tilting forwards and backwards, and supports the upper body of the care receiver.

5. The assistance device according to claim 1, wherein the body supporting member includes a torso support member configured to support a torso of the care receiver, and underarm support members provided on a left side and a right side of the torso support member and configured to support underarms of the care receiver, wherein the torso support member includes a support main body, and a cushion fixed to an upper rear side of the support main body, and wherein the first loading detecting apparatus and the second load detecting apparatus are disposed on the support main body.

* * * * *